United States Patent [19]

Hsu et al.

[11] Patent Number: 4,590,446

[45] Date of Patent: May 20, 1986

[54] RADIAL WAVEGUIDE POWER DIVIDER/COMBINER

[75] Inventors: Ting-Ih Hsu; Mario D. Simonutti, both of Manhattan Beach, Calif.

[73] Assignee: TRW Inc., Redondo Beach, Calif.

[21] Appl. No.: 625,875

[22] Filed: Jun. 28, 1984

[51] Int. Cl.[4] ..... H01P 5/12

[52] U.S. Cl. ..... 333/125; 333/33

[58] Field of Search ..... 333/124, 125, 136, 137; 330/277, 286, 295, 124 R; 331/56

[56] References Cited

U.S. PATENT DOCUMENTS 3,290,682 12/1966 Ajioka ..... 333/137 X 3,582,813 6/1971 Hines ..... 331/56

4,463,324 7/1984 Rolfs ..... 333/26

*Primary Examiner*—Paul Gensler

*Attorney, Agent, or Firm*—Noel F. Heal; Robert M. Wallace

[57] ABSTRACT

A waveguide structure operable as a power combiner or a power divider at millimeter-wave frequencies and having desirably low losses, large bandwidth and high power transmitting characteristics. The structure includes a single rectangular input/output waveguide, coupled to a circularly symmetrical waveguide section, which is in turn coupled to a radial waveguide. The radial waveguide has disposed about its periphery multiple transitions to rectangular output/input waveguides.

10 Claims, 2 Drawing Figures

RADIAL WAVEGUIDE POWER DIVIDER/COMBINER

BACKGROUND OF THE INVENTION

This invention relates generally to radio-frequency (rf) power combiners and dividers, and more specifically, to combiners and dividers for use in the millimeter-wave frequency band. Higher powers at these frequencies can be obtained by combining the outputs of such devices as diodes that employ impact-ionization and trasit-time properties (IMPATT diodes). There is a need for a power combiner operable over a wide band of millimeter-wave frequencies and capable of handling high powers. Other applications, such as phased-array antennas, require a power dividing function, in which a single high-power rf input signal is to be split into a number of output signals, usually of equal but smaller powers.

Devices available to perform a power combining function include Kurokawa-type combiners, magic tee hybrid couplers and microstrip power dividers or combiners. The Kurokawa devices, named after K. Kurokawa, are well known in the waveguide field. Basically, a Kurokawa device includes a cavity to which are coupled a number of coaxial waveguides providing separate power inputs, such as from IMPATT diodes. Although devices of the Kurokawa type work satisfactorily in some applications, their chief limitation is a relatively narrow bandwidth, arising from their resonant nature.

Magic tee or hybrid couplers have relatively good bandwidth characteristics. Each tee combines two signals into a single output, but the arrangement has significant limitations. There is a practical limitation of four to eight input sources that may be combined. More importantly, for use in the millimeter-wave band of frequencies, these couplers have high loss.

Microstrip combiners or dividers employ combinations of microstrip structures, each consisting of a conductive strip disposed on a dielectric sheet separating the strip from a ground plane. The chief limitation of microstrip structures intended for use as power combiners or dividers is that they have relatively high losses at millimeter-wave frequencies, and are therefore incapable of handling high powers at these frequencies.

Radial line combiners using microstrip structures have been disclosed in U.S. Pat. Nos. 4,371,845 to Pitzalis, Jr., 4,234,854 to Schellenberg et al., and 4,032,865 to Harp et al. Other attempts to produce a wideband non-resonant power combiner structure include a so-called radial line combiner, disclosed in U.S. Pat. No. 3,582,813 to Hines, in which solid-state power-generating devices are disposed around a central coaxial output line, to which they are coupled. Another proposed solution to the problem is the conical power combiner disclosed in U.S. Pat. No. 4,188,590 to Harp et al.

It will be appreciated from the foregoing that there is still a significant need for a power combiner and divider capable of operation at high powers and over a wide band of frequencies in the millimeter-wave band. Ideally, the combiner/divider should have relatively low losses and should couple to standard rectangular waveguides used in millimeter-wave applications. The present invention meets these requirements.

SUMMARY OF THE INVENTION

The present invention resides in an N-way divider/combiner network having the characteristics of low loss, wide bandwidth, and high power transmitting capability. Briefly, and in general terms, the divider/combiner network of the invention comprises a rectangular waveguide serving as an input/output port, a first waveguide transition, from rectangular to circularly symmetrical, a circularly symmetrical waveguide section coupled to the first waveguide transition, a second waveguide transition, from circularly symmetrical to radial, and a radial waveguide coupled to the second waveguide transition. The invention also includes a plurality (N) of waveguide transitions of a third type, from radial to rectangular, and a plurality (N) of rectangular waveguides coupled to the waveguide transitions of the third type, and serving as N output/input ports.

In the presently preferred embodiment of the invention, the circularly symmetrical waveguide section is of the coaxial type, and the radial waveguide is circularly symmetrical, to provide equal power outputs to the waveguide transitions of the third type. In the preferred embodiment of the invention, the radial waveguide, the waveguide transitions of the third type, and the plurality of rectangular output/input waveguides are formed as a unitary structure.

More specifically, the first waveguide transition includes a matching bead extending into the rectangular input/output waveguide from the coaxial waveguide section, and a backshort element disposed in the rectangular input/output waveguide. The second waveguide transition includes a matching bead extending into the center of the radial waveguide from the coaxial waveguide section. The waveguide transitions of the third type include a like plurality of rectangular ports disposed uniformly about the periphery of the radial waveguide, and a plurality of dielectric matching chips disposed in the rectangular ports.

It will be appreciated from the foregoing that the present invention represents a significant advance in the field of of radio-frequency power dividers and combiners. In particular, the invention provides a power divider/combiner network capable of operating over a wide bandwidth in the millimeter-wave frequency band at high powers and relatively low losses. Other aspects and advantages of the invention will become apparent from the following more detailed description, taken in conjunction with the accompanying drawings.

DESCRIPTION OF THE PREFERRED EMBODIMENT

Figure 1:
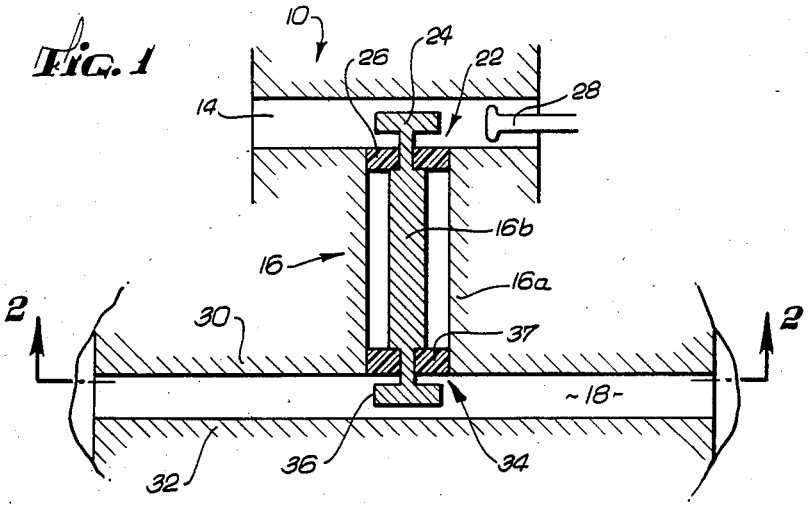
FIG. 1 is a cross-sectional view of the waveguide structure of the invention, showing waveguide transitions from rectangular to coaxial sections, and from coaxial to radial sections.
Figure 2:
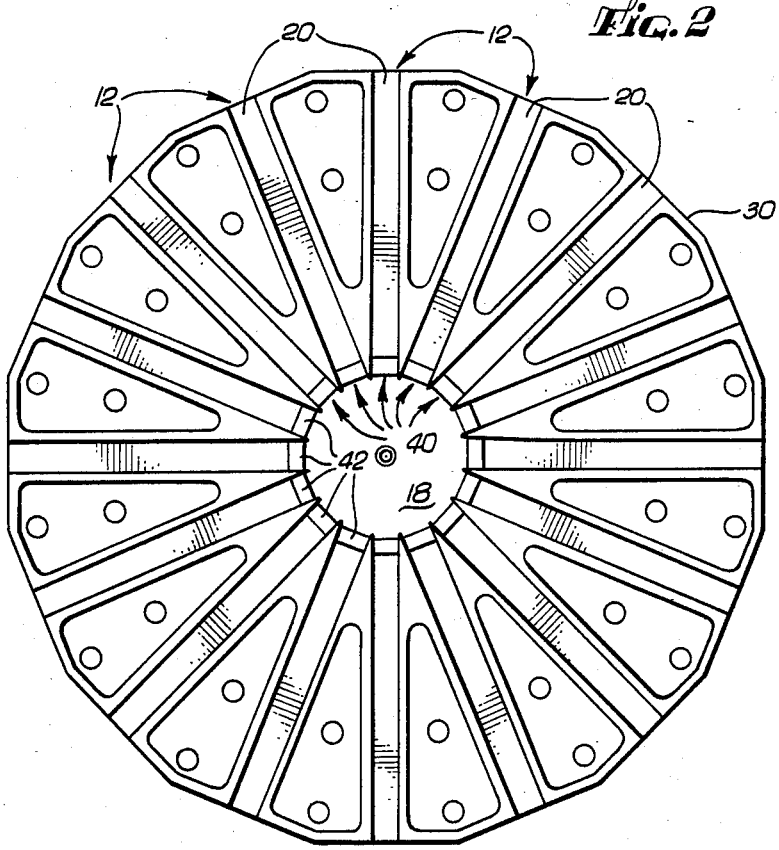
FIG. 2 is sectional view of the waveguide structure, taken substantially along the line 2—2 of FIG. 1, and showing the transitions between radial and rectangular waveguide sections.

As shown in the drawings for purposes of illustration, the present invention is concerned with high-frequency power combiners and dividers. Other types of combiners available prior to this invention have suffered from various limititations, and have not been able to handle high powers at high frequencies, in the millimeter-wave range, with low losses and with a wide bandwidth characteristic.

In accordance with the present invention, a single rectangular waveguide input port, indicated by reference numeral 10, is coupled to a plurality of rectangular waveguide output ports 12 through a novel combination of waveguide elements. The combination includes a rectangular waveguide section 14, a circularly symmetrical waveguide section 16, a radial waveguide section 18, and a plurality of rectangular waveguide sections 20.

It will be understood, of course, that the terms "input" and "output" can be interchanged in this description. Accordingly, the structure can also operate as a power combiner, having a plurality of input ports and a single output port.

More specifically, the input rectangular waveguide section 14 has an opening 22 in one of its walls, to effect a transition to the circularly symmetrical section 16, which, in the illustrative embodiment, is a coaxial waveguide. The coaxial waveguide 16 includes an outer cylindrical conductive wall **16*a* that merges with a wall of the rectangular waveguide 14 at the opening 22, and an axial conductive element 16*b*. The axial element 16*b* has a reduced-diameter portion at the opening 22, and extends through the opening, to terminate in an integral matching bead 24. The matching bead 24 takes the form of a relatively short cylinder coaxial with the axial waveguide section 16*b*. An annular ring 26 of Teflon or similar material fills the opening 22 between the axial waveguide section 16*b* and the outer wall 16*a*. The rectangular waveguide section 14 extends for some distance beyond the opening 22, and is terminated by a conductive backshort element 28**, in accordance with conventional techniques for matching a rectangular waveguide with a coaxial one.

The coaxial waveguide section 16 is coupled at its other end to the center of the radial waveguide 18. The latter consists of a pair of circular, spaced-apart, conductive plates 30 and 32. The coaxial waveguide 16 terminates at a central opening 34 in the upper plate 30. The axial conductive element **16*b* includes a reduced-diameter portion at the opening 34, and terminates in a matching bead 36 of cylindrical configuration, disposed between the two plates 30 and 32. An insulating annular ring 37 fills the space about the reduced-diameter portion of the element 16*b* at the opening 34**.

Energy coupled from the coaxial waveguide section 16 into the circular space between the two plates 32 and 34, propagates radially out from the center in a uniform manner. The radial waveguide 18 terminates at its periphery in a plurality of rectangular openings 40, each of which opens into one of the plurality of rectangular waveguides 20. Matching of each of the transitions from the radial waveguide 18 to one of the rectangular waveguides 20 is effected by a dielectric chip 42 disposed in each of the openings 40. Preferably, the rectangular waveguides 20 are formed in one or both of the flat plates 30 and 32 that also define the planar boundaries of the radial waveguide 18. In the illustrative embodiment of the invention, the rectangular waveguides are formed in the upper plate 30. Both plates 30 and 32 are N-sided polygons in plan view, and the rectangular waveguides 20 terminate at the N output ports 12, located at the N edges of the plates. The rectangular output ports 12 and the input port 10 are all sized for connection to standard rectangular waveguides useed in millimeter-wave applications.

Although the invention has application over a wide range of operating frequencies, and using different values of N, the number of output ports, it will be appreciated that these parameters will affect the appropriate choice of dimensions of the waveguides and waveguide transitions. However, for the sixteen-way divider/combiner that is illustrated, designed for an operating frequency in the V-band (60 gigahertz), the following dimensions have proved highly satisfactory. For other frequencies and configurations, the dimensions may have to be varied to achieve optimum performance.

The circular plates 30 and 32 are 3.300 inch in external diameter, measured from one output port to a diametrically opposite one, and the diameter of the radial waveguide 18 is 0.804 inch. The rectangular waveguides 20 are 0.148 inch wide by 0.074 inch deep, which is the same size as the input rectangular waveguide 14. The dielectric chips 42 are each 0.145 inch wide by 0.040 inch long (measured along the waveguide), and 0.010 inch thick.

The plates 30 and 32 defining the radial waveguide 18 are spaced apart by 0.074 inch, and the matching bead 36 has a diameter of 0.045 inch and a length of 0.040 inch. It is positioned with its free end at a distance of 0.066 inch from the upper plate 30.

The coaxial waveguide section 16 has an outer wall of inside diameter 0.060 inch, and the axial element **16*b* is of diameter 0.022 inch, thinned to 0.0145 at the openings 22 and 34. The matching bead 24 is located at the transition from the input rectangular waveguide 14 is also 0.045 inch in diameter and 0.040 inch long, but is positioned with its free end located at 0.057 inch from the face of the rectangular waveguide in which the opening 22** is located.

It will be appreciated from the foregoing that the present invention represents a significant advance in the field of dividers and combiners for high-power rf signals. In particular, the invention provides a non-resonant device for coupling one rectangular waveguide to a plurality of other rectangular waveguides, to operate either as a power combiner or as a power divider, at high powers, low losses and frequencies as high as the millimeter-wave band.

It will also be appreciated that, although a specific embodiment of the invention has been described in detail by way of illustration, various modifications may be made without departing from the spirit and scope of the invention. For example, in some applications the coaxial waveguide section 16 may be a circular waveguide for use at high powers. Moreoever, the radial waveguide 18, although described as circularly symmetrical and making a uniform distribution of power, may be asymmetrical in some applications, or may distribute power non-uniformly, as to a phased-array antenna. Accordingly, the invention is not to be limited except as by the amended claims.

We claim:

1. A non-resonant N-way power divider/combiner network having a large bandwidth, comprising:

a rectangular waveguide serving as an input/output port;

a first waveguide transition, from rectangular to circularly symmetrical;

a circularly symmetrical waveguide section of the coaxial type coupled to the first waveguide transition;

a second waveguide transition, from circularly symmetrical to radial;

a radial waveguide coupled to the second waveguide transition;

a plurality (N) of waveguide transitions of a third type, from radial to rectangular; and a plurality (N) of rectangular waveguides coupled to the waveguide transitions of the third type, to serve as N output/input ports.

2. An N-way power divider/combiner network as set forth in claim 1, wherein:

the radial waveguide is circularly symmetrical, and provides equal power outputs to the waveguide transitions of the third type.

3. An N-way power divider/combiner network as set forth in claim 1, wherein:

the radial waveguide, the waveguide transitions of the third type, and the plurality of rectangular waveguides are formed as a unitary structure.

4. An N-way power divider/combiner network as set forth in claim 1, wherein:

the first waveguide transition includes a matching bead extending into the rectangular input/output waveguide from the coaxial waveguide section, and a backshort element disposed in the rectangular input/output waveguide.

5. An N-way power divider/combiner network as set forth in claim 1, wherein:

the second waveguide transition includes a matching bead extending into the center of the radial waveguide from the coaxial waveguide section.

6. An N-way power divider/combiner network as set forth in claim 1, wherein the waveguide transitions of the third type include:

a like plurality of rectangular ports disposed uniformly about the periphery of the radial waveguide; and a plurality of dielectric matching chips disposed in the rectangular ports.

7. A non-resonant N-way power divider/combiner network having a large bandwidth, comprising:

a rectangular waveguide serving as an input/output port;

a first waveguide transition, from rectangular to coaxial;

a coaxial waveguide section coupled to the first waveguide transition;

a second waveguide transition, from coaxial symmetrical to radial;

a circularly symmetrical radial waveguide coupled to the second waveguide transition, and having a pair of parallel waveguide plates to propagate energy uniformly in a radial sense;

a plurality (N) of waveguide transitions of a third type, from radial to rectangular; and a plurality (N) of rectangular waveguides coupled to the waveguide transitions of the third type, to serve as N output/input ports.

8. An N-way power divider/combiner network as set forth in claim 8, wherein:

the first waveguide transition includes a matching bead extending into the rectangular input/output waveguide from the coaxial waveguide section, and a backshort element disposed in the rectangular input/output waveguide.

9. An N-way power divider/combiner network as set forth in claim 8, wherein:

the second waveguide transition includes a matching bead extending into the center of the radial waveguide from the coaxial waveguide section.

10. An N-way power divider/combiner network as set forth in claim 8, wherein the waveguide transitions of the third type include:

a like plurality of rectangular ports disposed uniformly about the periphery of the radial waveguide; and a plurality of dielectric matching chips disposed in the rectangular ports.

* * * * *